US005845823A

United States Patent [19]

Lindmayer

[11] Patent Number: 5,845,823

[45] Date of Patent: Dec. 8, 1998

[54] CONTAINER COVER AND DISPENSING DEVICE

[75] Inventor: Stephan Lindmayer, Pierrefonds, Canada

[73] Assignee: Advanced Jet Technologies Inc., Montreal, Canada

[21] Appl. No.: 747,759

[22] Filed: Nov. 13, 1996

[51] Int. Cl.[6] ..... B65D 47/00

[52] U.S. Cl. ..... 222/545; 222/464.1; 222/505

[58] Field of Search ..... 222/464.1, 505, 222/545

[56] References Cited

U.S. PATENT DOCUMENTS

| | | | |
|---|---|---|---|
| 2,678,147 | 5/1954 | Abplanalp | 222/545 |
| 3,422,448 | 1/1969 | Johnston | 222/464.1 |
| 3,998,274 | 12/1976 | Liautaud | 222/464.1 |
| 4,694,975 | 9/1987 | Hagan | 222/545 |
| 4,995,534 | 2/1991 | Norman | 222/464.1 |
| 5,465,880 | 11/1995 | Glynn | 222/383.1 |
| 5,472,119 | 12/1995 | Park et al. | 222/383.1 |

*Primary Examiner*—Andres Kashnikow
*Assistant Examiner*—Keats Quinalty
*Attorney, Agent, or Firm*—George A. Seaby

[57] ABSTRACT

A simple cover and dispenser combination for bottles containing carbonated colas and pressurized liquids includes a cap for mounting in sealing engagement on the top end of a bottle; a sleeve extending downwardly from the center of the cap for receiving liquid from the interior of the container, and for discharging the liquid through a central opening in the cap; a valve seat in the sleeve around the bottom of the opening; and a valve in the sleeve, the valve including a tubular body fixed in the sleeve, a head on the body normally sealing against the valve seat, a plunger extending upwardly from the head through the central opening, and a resilient cage, defining a section of the body beneath the head, whereby the plunger can be pressed downwardly to deform the cage and open the valve by moving the head away from the seat, permitting the dispensing of fluid through the opening.

14 Claims, 13 Drawing Sheets

CONTAINER COVER AND DISPENSING DEVICE

FIELD OF THE INVENTION

This invention relates to a container cover and dispensing device.

More specifically, the invention relates to a bottle cover and dispensing device for use on a container for liquid under pressure such as a cola or other carbonated soft drink.

DISCUSSION OF THE PRIOR ART

In general, carbonated beverages are available in small glass or plastic bottles or in metal cans for immediate consumption, or in a variety of large glass or plastic bottles. Larger bottles are intended to store some of the beverage after the bottle has been opened and some of the contents removed. Often the beverage remains in a previously opened bottle for days at a time, and the carbonation often dissipates leaving the drink "flat". Moreover, the mere act of pouring a soft drink from a bottle (particularly by children) can be awkward and messy.

GENERAL DESCRIPTION OF THE INVENTION

Accordingly, a need exists for a cover and dispensing device which facilitates dispensing of carbonated or other beverages under pressure, and which reduces the loss of pressure on already opened containers, i.e. containers from which some of the contents have been dispensed.

An object of the present invention is to meet the above defined need by providing a relatively simple and inexpensive container cover and dispensing device, which makes it easy to dispense a liquid under pressure, without moving the bottle containing the liquid.

A second object of the invention is to provide a device which, once placed on the container remains in position and reduces the likelihood of loss of pressure until all of the liquid has been dispensed.

Another object of the invention is to provide a device which makes it difficult to dispense the liquid in a container unintentionally which is important in households with young children.

Accordingly, the invention relates to a cover and dispensing device for use on a container of liquid under pressure comprising, cap means for mounting on the open top end of the container, said cap means including cylindrical side wall means and circular top wall means for mounting in sealing engagement on the open top end of the container; sleeve means extending downwardly from said top wall means said sleeve means having an open bottom end for receiving fluid from the container, an open top end for discharging fluid from the container and valve seat means in said open top end; and valve means in said sleeve means; said valve means including tubular body means fixed in said sleeve means; head means on said body means normally sealing against said seat means; plunger means extending upwardly from said head means through said top wall means; and resilient cage means defining a section of said valve body means beneath said head means, whereby, when said plunger means is pressed downwardly, said cage means is deformed to move said head means away from said seat means permitting the discharge of fluid through said cage means and from the container.

BRIEF DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT

Figure 1:
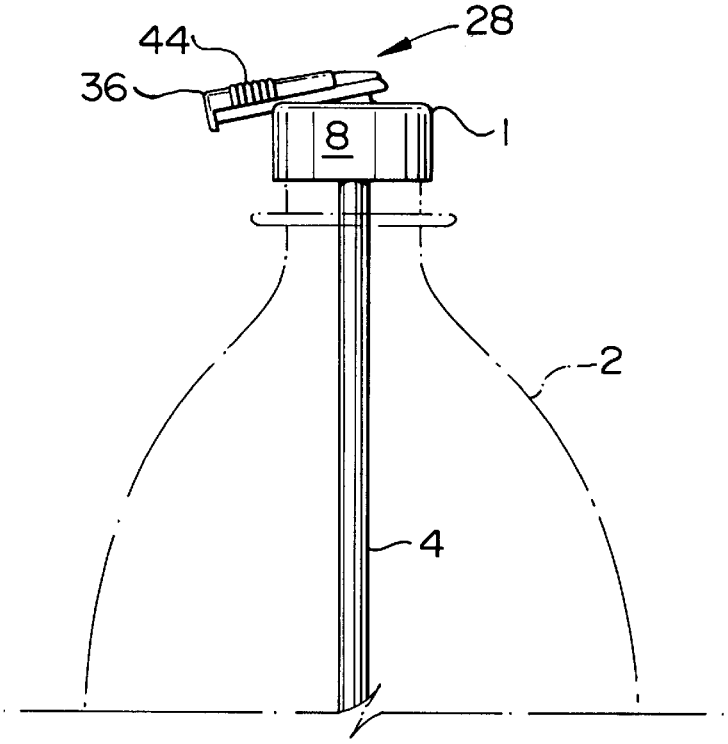
FIG. 1 is a side view of a container cover and dispensing device in accordance with the present invention on the top end of a container.
Figure 2:
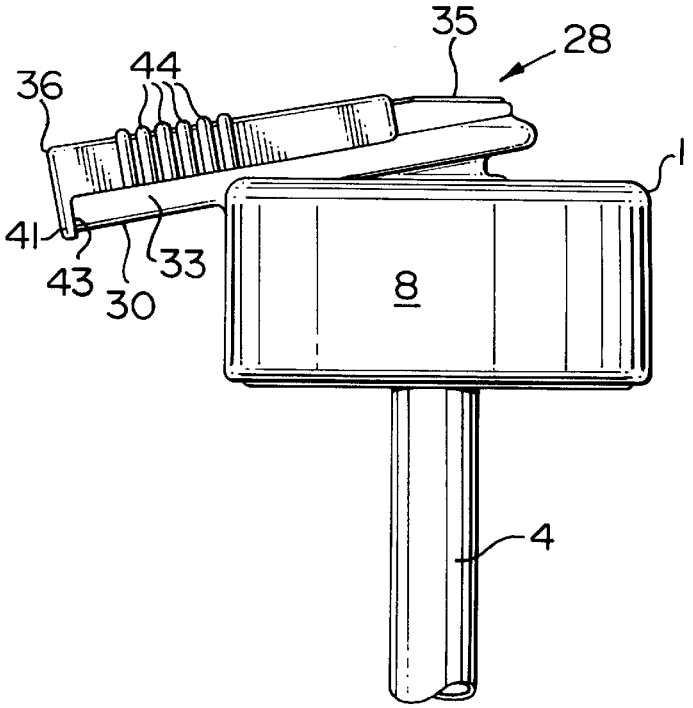
FIG. 2 is a side view of the device of FIG. 1 on a larger scale.
Figure 3:
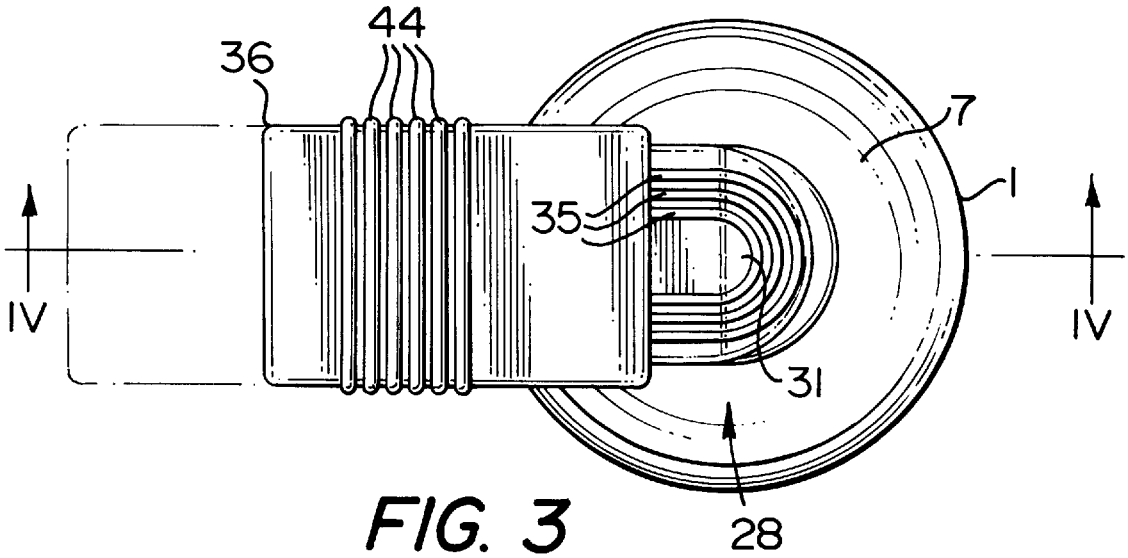
FIG. 3 is a top view of the device of FIGS. 1 and 2.

Wherever possible the same reference numerals have been used to identify the same or similar elements in the various figures of the drawings. In many cases, elements have been omitted from figures of the drawings to simplify illustration of the invention. In the following detailed description, the only container described for use with the device of the present invention is a plastic soft drink bottle. However, it will be appreciated that the device can be used on other containers for pressurized liquid.

With reference to FIGS. 1 to 5, the basic elements of a cover device in accordance with the present invention include a cap 1 for mounting in sealing engagement on the open top end of a bottle 2, a tube 4 extending between the bottom of the bottle 2 and the cap 1, and a valve body 5 (FIGS. 4 to 6) mounted in the cap 1.

Figure 4:
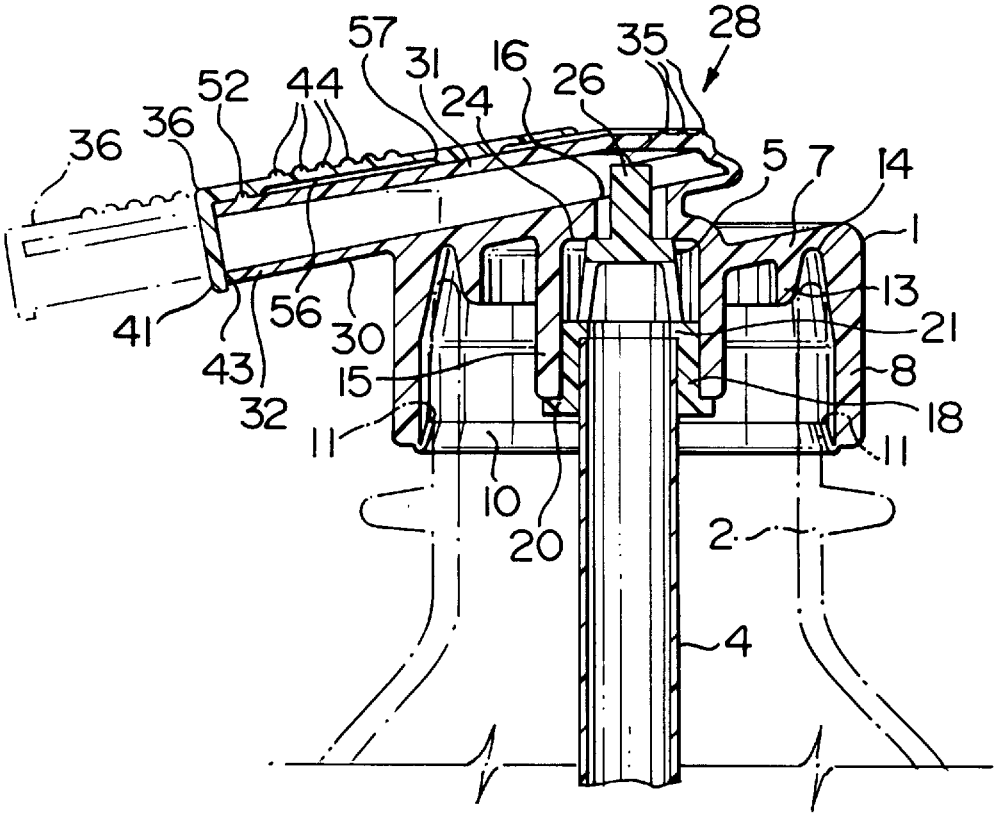
FIG. 4 is a cross section taken generally along line IV—IV of FIG. 3 showing the device in the closed and open positions.
Figure 5:
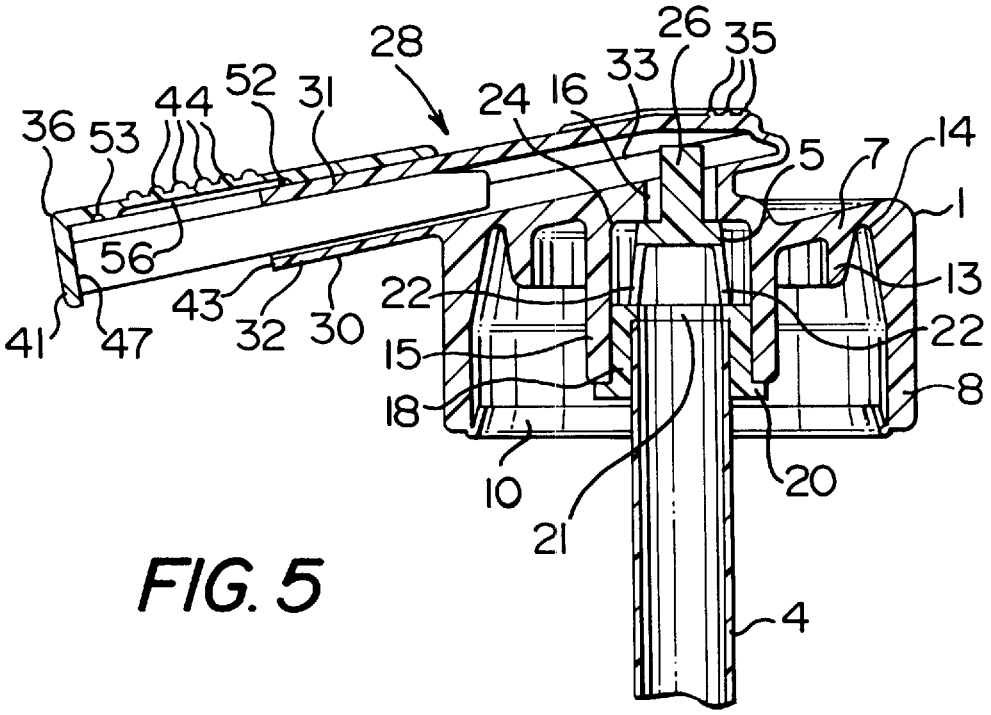
FIG. 5 is a cross section similar to FIG. 4 showing the device in the open position.

The cap 1 is defined by a circular, slightly concave top wall 7, and a cylindrical side wall 8 integral with the top wall 7 and extending downwardly therefrom. The cap 1 is retained on the bottle 2 by a thin, upwardly and inwardly inclined, annular skirt or flange 10 on the bottom end of the side wall 8. The flange 10 engages a shoulder 11 on the top end of the bottle 2. A seal between the cap 1 and the bottle 2 is achieved by means of an annular wall 13 parallel to and substantially shorter than the side wall 8. As best shown in FIG. 4, when the cap 1 is placed on a bottle 2 the top end of the bottle extends into an inverted V-shaped recess 14 between the wall 8 and the annular wall 13. Thus, a seal is achieved between the top end of the bottle 2 and the cap 1.

Figure 6:
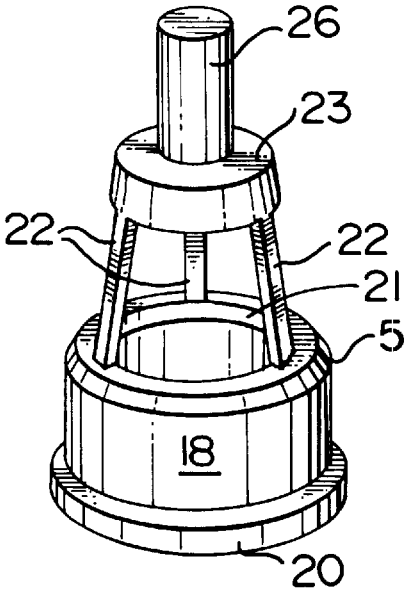
FIG. 6 is a perspective view of a valve body used in the device of FIGS. 1 to 5.

A sleeve 15 (FIGS. 4 and 5) extends downwardly around a central opening 16 in the top wall 7 of the cap 1. The sleeve 15 defines a valve casing for the valve body 5. As best shown in FIG. 6, the valve body 5 includes a tubular, cylindrical bottom section 18 which is retained in the sleeve 15 by friction. An annular flange 20 on the bottom end of the section 18 limits upward movement of the valve body 5 in the sleeve 15. The top end of the tube 4 extends into the bottom section 18 of the valve body 5 and abuts an annular, inwardly extending flange or shoulder 21 at the upper end of such bottom section. Three narrow, resilient arms 22 extend upwardly and inwardly from the upper end of the bottom section 18 and support a disc 23 of smaller diameter than the bottom section 18. The disc 23 normally rests against a shoulder 24 around the opening 16 (FIGS. 4 and 5) in the top wall 7 of the cap which defines a valve seat. The valve body is formed of a material such as a rubber, which is sufficiently resilient and flexible that the arms 22 are relatively easy to bend and the disc 23 seals tightly against the shoulder 24. The disc 23 is moved away from the valve seat by a plunger 26 extending upwardly from the center of the disc 23 through the opening 16. The plunger 26 is smaller in diameter than the opening 16 so that fluid can escape through the opening when the valve is open.

Figure 7:
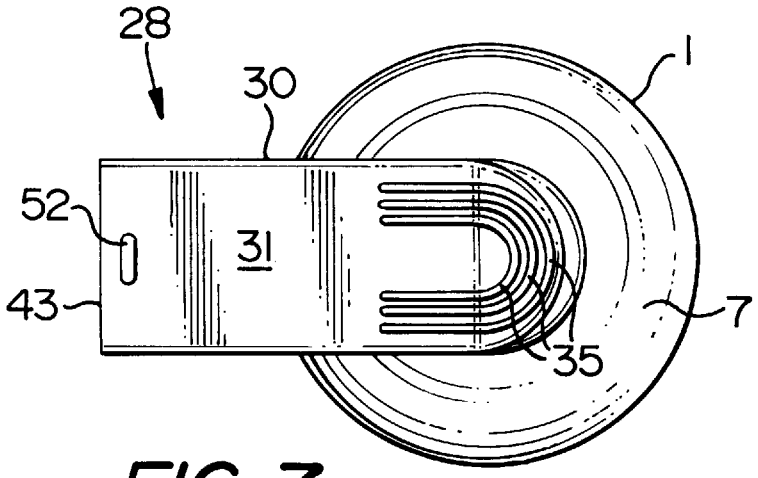
FIG. 7 is a top view of the device of FIGS. 1 to 5 with the cover removed.
Figure 8:
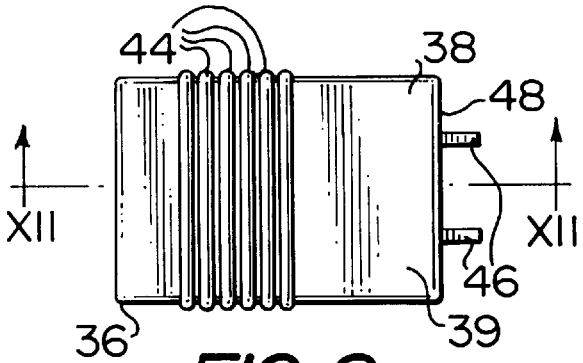
FIG. 8 is a top view of a cover used on the device of FIGS. 1 to 5.
Figure 9:
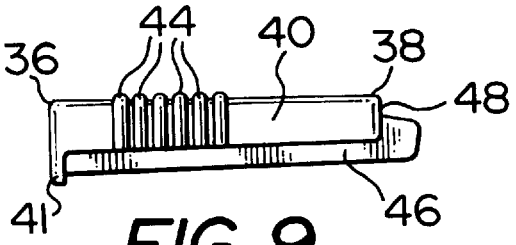
FIG. 9 is a side view of the cover of FIG. 8.
Figure 10:
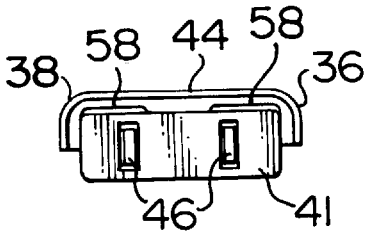
FIG. 10 is an end view of the cover of FIGS. 8 and 9 as seen from the right of FIG. 9.
Figure 11:
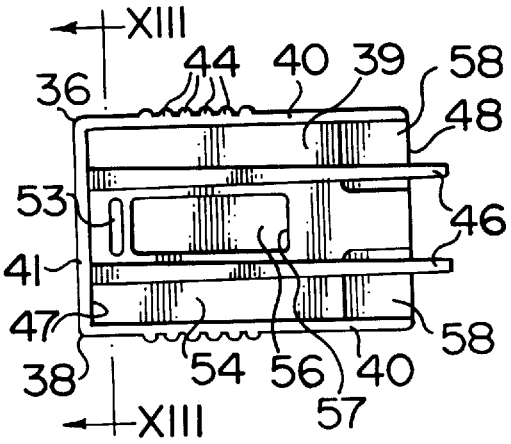
FIG. 11 is a bottom view of the cover of FIGS. 8 to 10.
Figure 12:
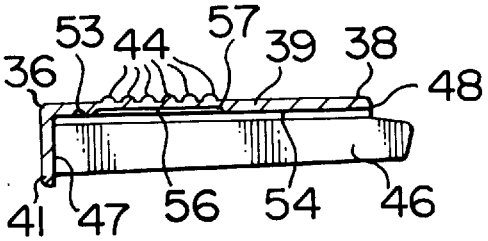
FIG. 12 is a cross section taken generally along line XII—XII of FIG. 8.
Figure 13:
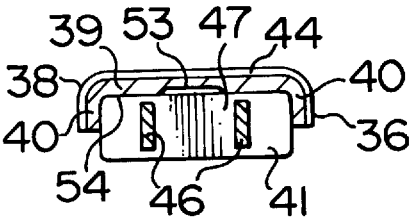
FIG. 13 is a cross section taken generally along line XIII—XIII of FIG. 11.

Fluid escaping through the opening 16 is discharged from the device via a downwardly inclined dispensing nozzle generally indicated at 28 integral with the cap 1. The nozzle 28 (FIGS. 7, 15 and 18) includes a elongated, generally rectangular cross section body 30 defined by a top wall 31, a bottom wall 32 and side walls 33. The side walls 33 are generally V-shaped in cross section to facilitate flexing of the nozzle in the manner of an accordion. Small, generally U-shaped ridges 35 extend upwardly from the top wall 31 near the semicircular inner end thereof. The ridges 35 define finger grips for the user, i.e. prevent sliding of a fingertip from the top wall 31 when the device is being used. The valve is opened during a dispensing operation by pressing down on the top wall 31 against the plunger 26 to flex the arms 22 and thus move the disc 23 away from the valve seat (shoulder 24). The liquid in the bottle 2 is propelled therefrom by its own pressure, i.e. by the carbonation pressure.

In the first embodiment of the invention, the nozzle 28 is closed by a cover 36 when the device is not in use. The cover 36 not only closes the nozzle 28, but prevents an unauthorized or accidental dispensing operation, for example by a child. As best shown in FIGS. 8 to 13, the cover 36 includes an elongated, rectangular body 38 with an open bottom end which is defined by a rectangular top wall 39, side walls 40 and an outer end wall 41. The end wall 41 is wider than the side walls 40 for closing the outer, discharge end 43 of the nozzle 28. A plurality of small ribs 44 extend transversely of the top and side walls of the cover 36 facilitating fingertip gripping and moving of the cover. The cover 36 is slidably mounted on the nozzle body 30 by means of a pair of slides defined by elongated arms 46 connected at one end to the interior surface 47 of the cover end wall 41. The arms 46 extend from the end wall 41 to a location beyond the other, open end 48 of the cover, so that, when the cover 36 is in the closed position (shown in solid lines in FIG. 4), the inner, free ends of the arms 46 bear against the upper, inner end of the top wall 31 of the nozzle 28. Thus, the arms 46 prevent downward movement of the top wall 31 and consequently of the plunger 26 and opening of the valve.

The cover 36 is maintained on the nozzle 28 by a stop defined by a small transversely extending projection 52 (FIGS. 4, 5, 7, 15 to 18) on the outer top end of the nozzle 28. In the closed position (FIG. 4) of the cover 36, the projection 52 rests in a small, straight groove 53 extending transversely of the inner surface 54 (FIGS. 11 to 13) of the top wall 39 of the cover near the outer end wall 41. The projection 52 and the groove 53 act as a lock for releasably latching the cover 36 in the closed position. By applying downward and outward pressure to ribs 44, the cover 36 is caused to move outwardly. When the cover 36 moves outwardly, the projection 52 enters an elongated rectangular recess 56 in the inner surface 54 of the cover 36 for free sliding movement of the cover. The upper, inner end 57 of the recess 56 acts as a stop for limiting movement of the cover 36 to the open position (see FIG. 4 in phantom outline and FIG. 5 in solid lines). Square recesses 58 (FIGS. 10 and 11) are provided at the sides of the top end of the surface 54 so that the cover 36 can pass over the ends of the ridges 35 when moving to the closed position.

Figure 14:
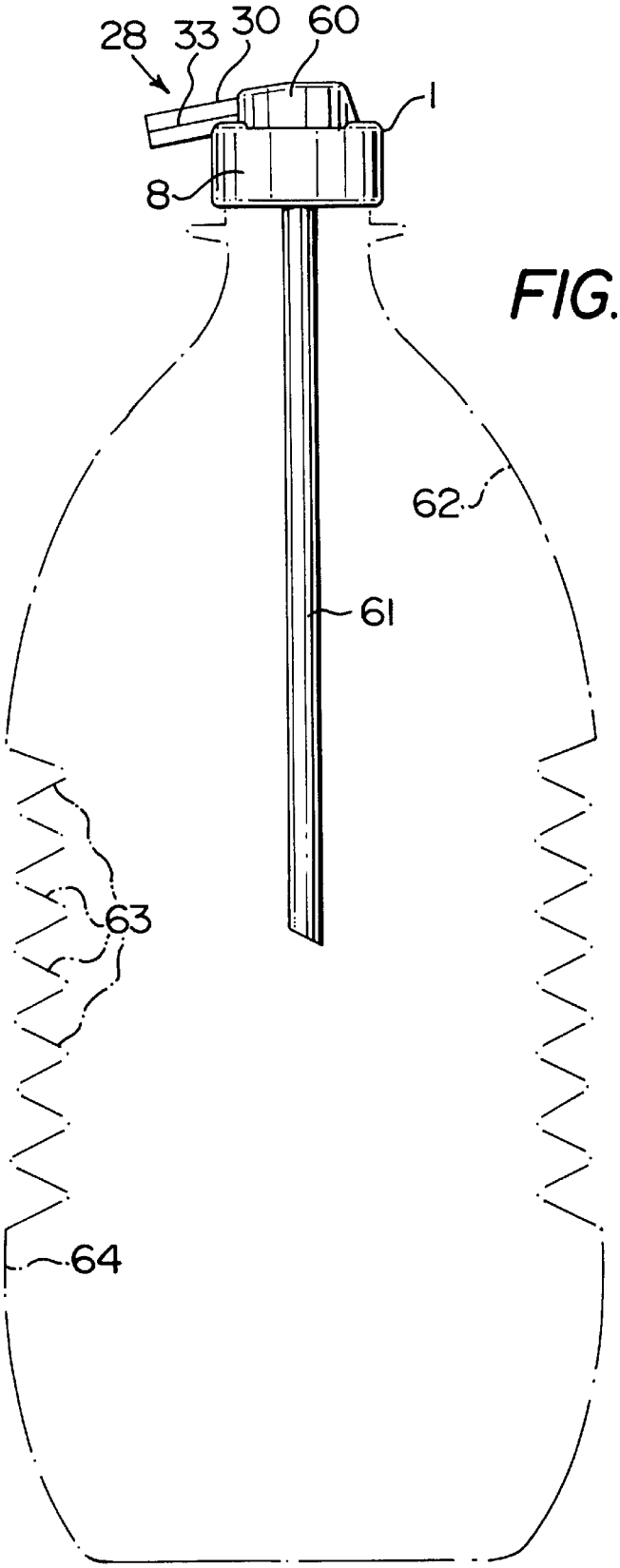
FIG. 14 is a side view of a second embodiment of a cover and dispensing device in accordance with the present invention.
Figure 16:
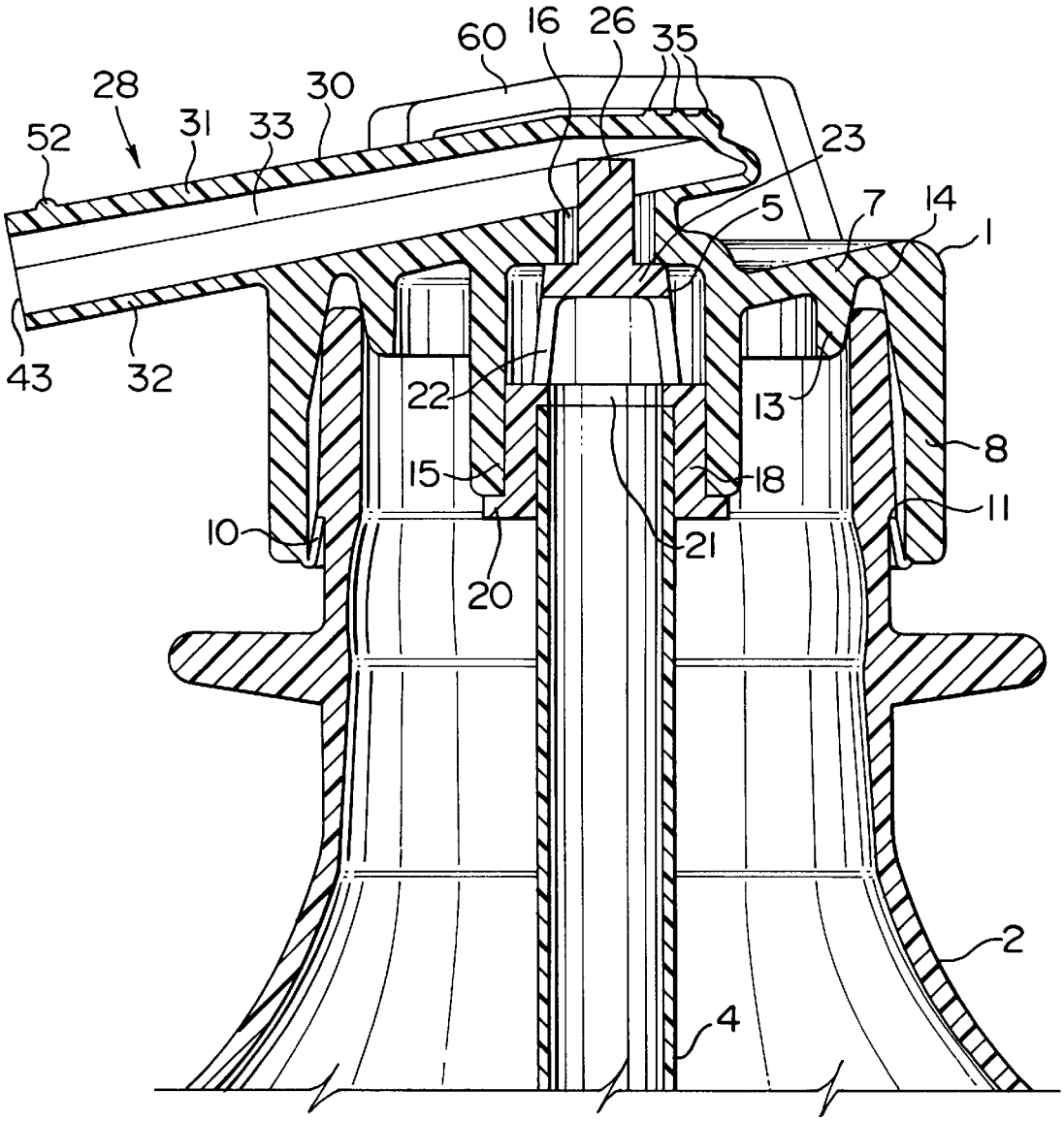
FIG. 16 is a cross sectional view of the device of FIGS. 14 and 15, and the top end of a bottle.
Figure 15:
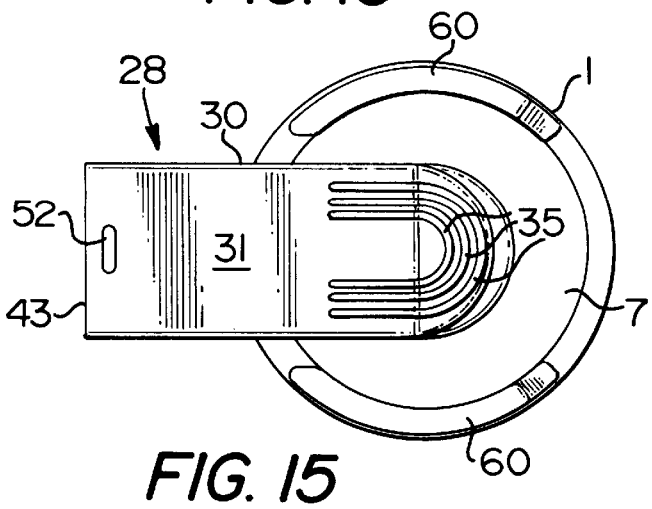
FIG. 15 is a top view of the device of FIG. 14.

A second embodiment of the invention (FIGS. 14 to 16) includes the same elements as described above in connection with FIGS. 1 to 13, and a pair of arcuate walls 60 extending upwardly from opposite sides of the top wall 7 of the cap 1. The walls 60 define barriers which limit ready access to the nozzle 28 to locations immediately in front of and immediately behind the nozzle. This arrangement further reduces the likelihood of accidental or unauthorized opening of the valve, and as shown in FIGS. 14 to 16, can be used without the cover 36. As shown in FIG. 14, the dispensing device can be used with a short tube or straw 61 on an accordion-type bottle 62, which incudes pleats 63 in the side wall 64 thereof, whereby the bottle collapses as the contents are discharged therefrom.

Figure 18:
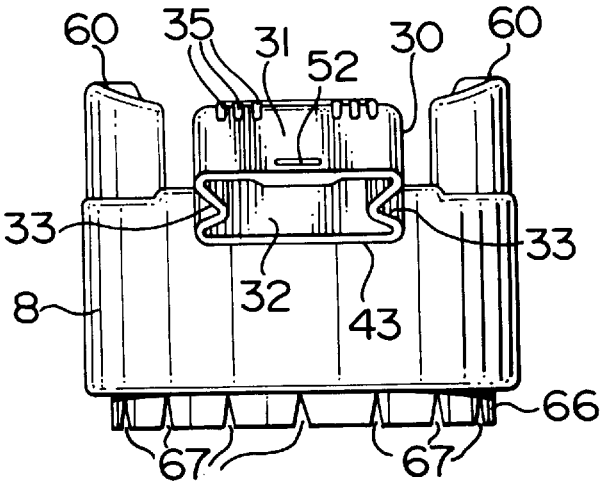
FIG. 18 is an end view of the device of FIG. 17 as seen from the left of such figure.
Figure 17:
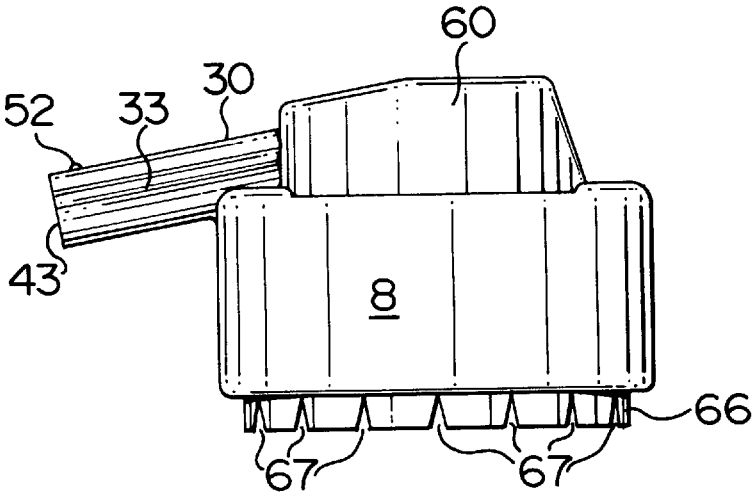
FIG. 17 is a side view of a third embodiment of the cover and dispensing device of the present invention.

With reference to FIGS. 17 and 18, a third embodiment of the invention, which is similar to the first two embodiments, includes a thin, annular skirt 66 extending downwardly from the bottom end of the sidewall 8 of the cap, for sealing engagement with a neck of a bottle (not shown). The skirt 66, which includes a plurality of V-shaped grooves 67 therein, replaces the flange 10 used in the first two embodiments of the invention.

Figure 19:
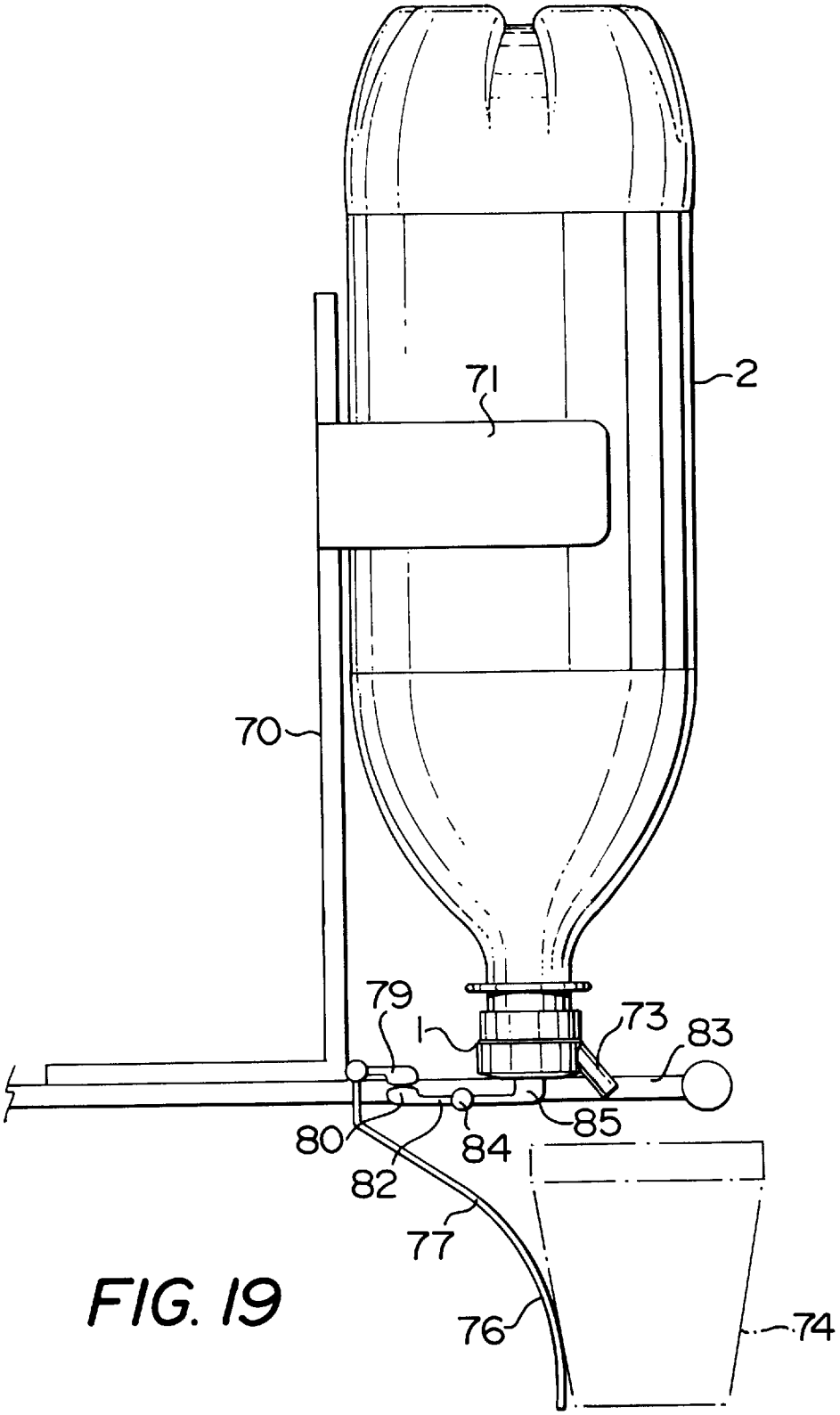
FIG. 19 is a schematic side view of a fourth embodiment of the device of the present invention on a bottle mounted in a stand.
Figure 20:
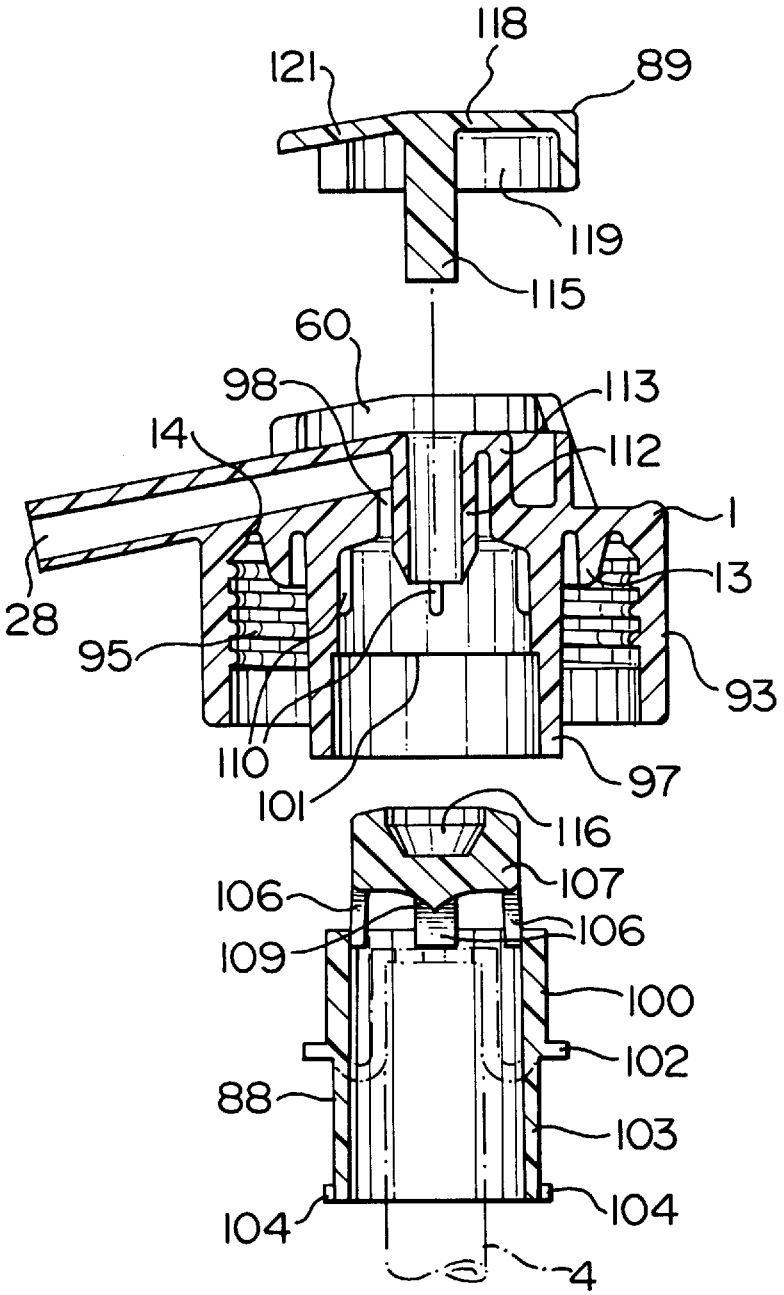
FIG. 20 is an exploded cross-sectional view of a fifth embodiment of the container cover and dispensing device.

A cover and dispensing device in accordance with the present invention can also be used for downward dispensing of the contents of a bottle 2 in which case the tube 4 can be omitted. As shown in FIG. 19, the bottle 2 can be mounted in an inverted position on an L-shaped stand 70 of the type including a bracket 71 for holding the bottle 2. The nozzle 73 of the cover and dispensing device is inclined downwardly (rather than upwardly) when the bottle and the device are in the inverted position. When a drinking glass 74 or other container for receiving some of the contents of the bottle 2 is pressed against an arcuate arm 76 of a resilient lever 77, the other arm 79 of the lever 77 rotates downwardly against one end 80 of a second lever 82. The lever 82 is pivotally mounted on a horizontal arm 83 of the stand 70 for rotation around a horizontal axis 84, whereby an outer free end 85 thereof presses upwardly against the top wall of the cap 1 to open the valve, initiating a dispensing operation. As long as pressure is applied to the bottom end of the lever 77, liquid will be dispensed form the bottle 2 (of course, until the bottle is empty). When the lever 77 is released by removal of the glass 74, the levers 77 and 82 return to the rest position, and the valve again closes, terminating the dispensing operation.

With reference to FIGS. 20 to 28, a fifth embodiment of the cover device of the present invention includes a cap 1 for mounting on the top end of a bottle, a tube 4 (FIGS. 20 and 21), a valve body 88, a plunger assembly 89 separate from the valve body 88, and a cover 90 slidable on the nozzle 28 of the cap 1 for closing the nozzle.

Like the cap of FIGS. 1 to 5, the cap 1 is defined by a circular top wall 92, and a cylindrical side wall 93 integral with the top wall 92 and extending downwardly therefrom. Threads 95 are provided on the interior of the side wall 93 for mounting the cover device on a plastic soft drink bottle. A seal between the cap 1 and the bottle is achieved by an annular wall 13 parallel to and substantially shorter than the side wall 93. As with the above described first embodiment of the invention, when the cap 1 is placed on a bottle, the top end of the bottle extends into an inverted V-shaped recess 14 between the wall 93 and the sleeve 13.

A sleeve 97 extends downwardly around a central opening 98 in the top wall 92 of the cap 1. The sleeve 97 defines a valve casing for a valve body 88. As best shown in FIGS. 20 and 22 to 25, the valve body 88 includes a tubular, cylindrical lower section 100, which is retained in the sleeve 97 by friction. A shoulder 101 in the sleeve 97 and an annular flange 102 extending outwardly from the middle of the lower section 100 limit movement of the valve body into the sleeve 97. The end 103 of the lower section 100 beneath the flange 102 has a thinner wall than the top end above the flange 102, so that the bottom end of the valve body can be rolled upwardly and inwardly for receiving the top end of the tube 4. Lugs 104 extend outwardly from the bottom end of the lower section, so that when the bottom end 103 is rolled up into the center of the lower section 100, the lugs 104 define stops for limiting movement of the tube into the valve body.

Figure 21:
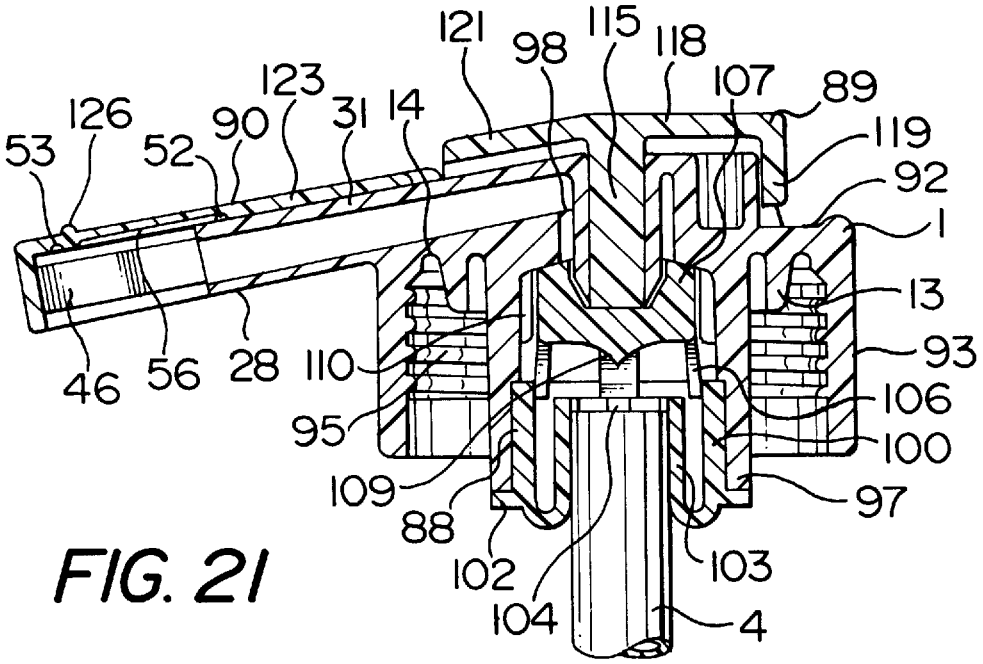
FIG. 21 is a cross-sectional view of the device of FIG. 20 in assembled condition.
Figure 22:
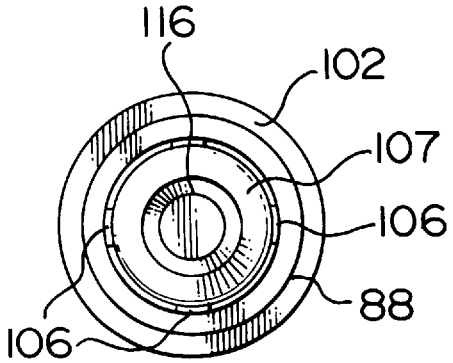
FIG. 22 is a top view of a valve body used in the device of FIGS. 20 and 21.
Figure 23:
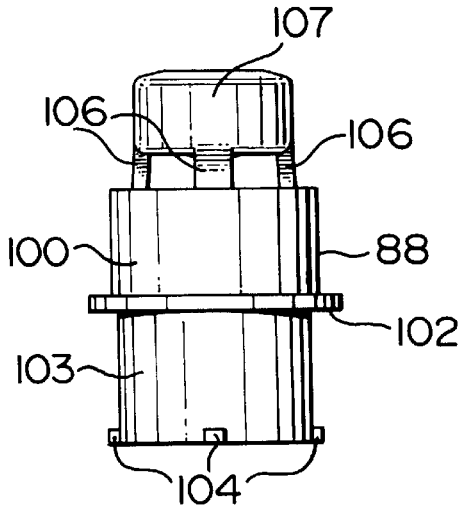
FIG. 23 is a side view of the valve body of FIG. 22.
Figure 24:
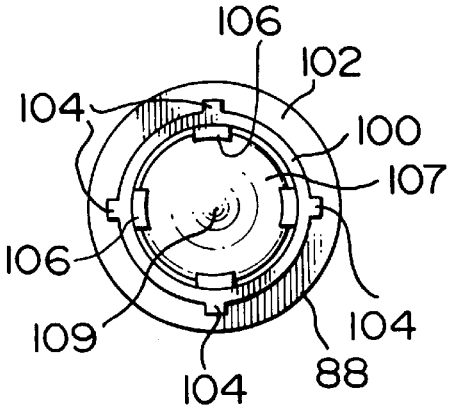
FIG. 24 is a bottom view of the valve body of FIGS. 22 and 23.
Figure 25:
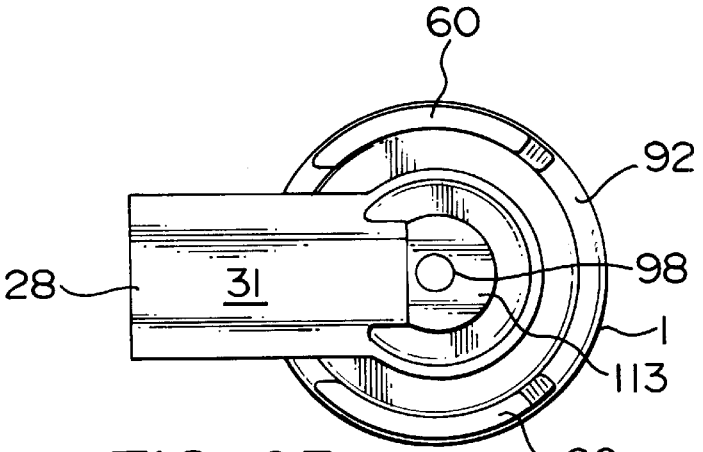
FIG. 25 is a top view of a cap used in the device of FIGS. 20 and 21.
Figure 26:
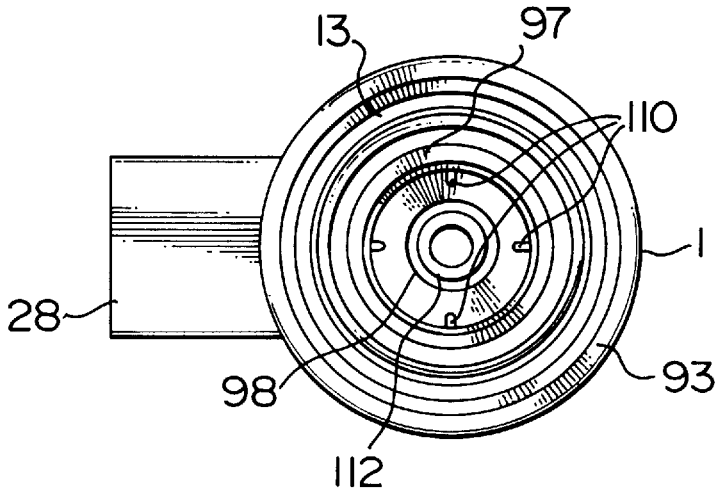
FIG. 26 is a bottom view of the cap of FIG. 25.
Figure 27:
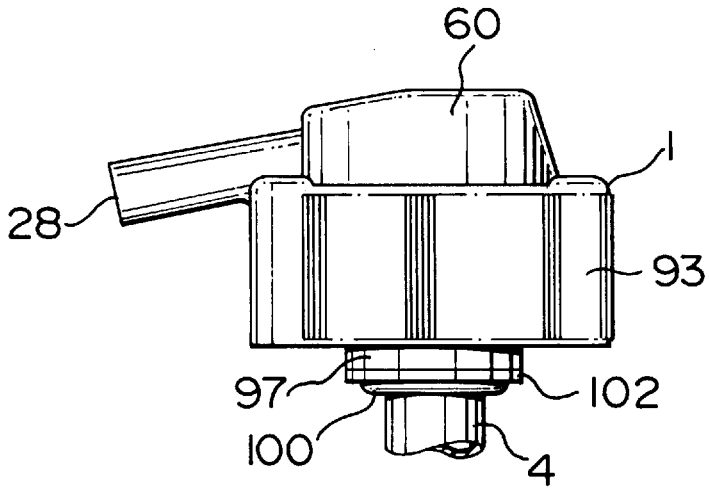
FIG. 27 is a side view of the cap of FIGS. 25 and 26, the bottom end of the valve body and the top end of a tube used in the device of FIGS. 20 and 21.

Four narrow, resilient arms 106 extend upwardly and inwardly from the top end of the lower section 100 of the valve body 88 and support a generally button-shaped head 107. A small pointed projection 109 is provided on the bottom center of the head 107 for directing liquid outwardly from the top of the straw 4 through the gap between the arms 106. The head 107 is centered and guided by four longitudinally extending ribs 110 in the top end of the sleeve 97. A tube 112 extends downwardly from the center of a raised portion 113 of the top wall 92 of the cap through the opening 98 for slidably receiving the plunger 115 of the plunger assembly 89. The bottom ends of the tube 112 and of the plunger 115 are seated in a central recess 116 in the head 107 of the valve body 88. As shown in FIG. 21, the plunger 115 is longer than the sleeve 112 so that the top end of the plunger extends upwardly beyond the top end of the raised central portion 113 of the top wall 92.

The plunger assembly 89 includes the plunger 115, a generally circular top plate 118 and a skirt 119 extending downwardly from all but one side of the top plate 118. One side 121 of the top plate 118 is inclined downwardly and extends outwardly over the top wall 31 of the nozzle 28. The inclined side 121 of the top wall 118 is parallel to and spaced apart from the top wall 31 of the nozzle 28, so that the plunger 115 can be moved downwardly to open the valve when pressure is exerted on the top wall 118. When the device is in use, the cover 90 (FIG. 21) is in an extended position so that liquid can be dispensed through the valve and the nozzle 28. Upon completion of a dispensing operation, the carbonation in the beverage returns the plunger assembly to the elevated, rest position. The cover 90 is slid upwardly on the nozzle 28, whereby the top wall 123 of the cover slides between that side 121 of the top wall 118 and the top wall 31 of the nozzle to prevent downwardly movement of the plunger assembly 89.

Figure 28:
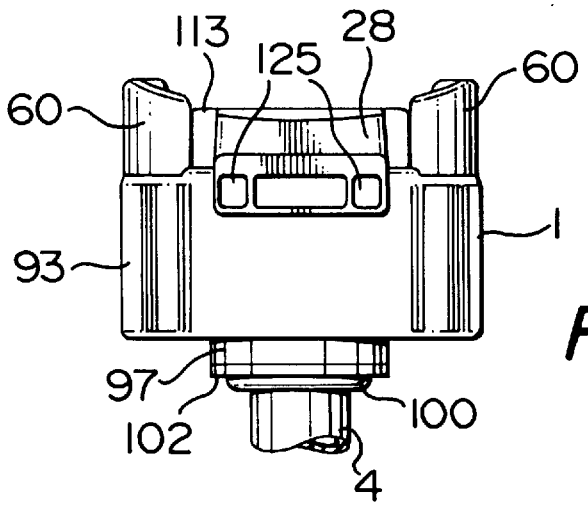
FIG. 28 is a front view of the cap, valve body and tube of FIG. 27.

While the nozzle 28 shown in FIG. 28 includes vertical partitions 125, it will be appreciated that such partitions can be omitted. The cover 90 is slidably mounted on the nozzle 28 in essentially the same manner as in the other embodiments of the invention. As shown in FIG. 21, arms 46 are provided on the cover 90 for sliding in the nozzle 28. Movement of the cover 90 is controlled by a projection 52 and the recess 56. A rib 126 extends transversely of the top of the cover 90 facilitating fingertip movement of the cover.

We claim:

1. A cover and dispensing device for use on a container of liquid under pressure comprising cap means for mounting on the open top end of the container, said cap means including cylindrical side wall means and circular top wall means for mounting in sealing engagement on the open top end of the container; sleeve means integral with and extending downwardly from said top wall means, said sleeve means having an open bottom end for receiving fluid from the container, an open top end for discharging fluid from the container and valve seat means in said open top end; and valve means in said sleeve means, said valve means including tubular body means in said sleeve means, said body means including head means normally sealing against said seat means, plunger means integral with and extending upwardly from said head means through said top wall means, and resilient cage means integral with and beneath said head means, whereby, when said plunger means is pressed downwardly, said cage means is deformed to move said head means away from said seat means permitting the discharge of fluid through said cage means and from the container.

2. A device according to claim 1, including tube means in the bottom end of said sleeve means for extending downwardly into liquid in the container and for conveying the liquid into said sleeve means.

3. A device according to claim 1, including tubular nozzle means on said top wall means, said nozzle means having an open outer end for discharging liquid from the container, and a resilient inner end covering said plunger means, whereby said inner end of the nozzle means can be pressed against said plunger means to open the valve means.

4. A device according to claim 3, including cover means slidable on said nozzle means for movement between a closed position in which the cover means closes the open outer end of the nozzle and an open position permitting the escape of liquid through said open outer end.

5. A device according to claim 4, wherein said cover means includes slide means slidable in said nozzle means between a latch position when the cover means is in the closed position preventing movement of said resilient inner end of said nozzle means against said plunger means and a release position when the cover means is in the open position permitting depression of said inner end of the nozzle means against said plunger means.

6. A device according to claim 5, wherein said cover means includes stop means for releasably retaining said cover means in the closed position, and for limiting movement of the cover means to a predetermined open position.

7. A device according to claim 3, including barrier means on said top wall means of the cap means for limiting ready access to said top wall means to an area aligned with said nozzle means.

8. A device according to claim 1, wherein said valve means includes flange means on the bottom end of said body means for positioning the body means in said sleeve means.

9. A device according to claim 8, wherein said valve body means includes a tubular, cylindrical bottom section fixed in said sleeve means and a smaller diameter upper section defining said cage means, said upper section including disc means defining said valve head means and carrying said plunger means, and a plurality of spaced apart, resilient arm means extending between said disc means and said bottom section of the valve body means.

10. A device according to claim 9, wherein said arm means are inclined downwardly and outwardly to said bottom section of said valve body means.

11. A device according to claim 1, including tubular nozzle means on said top wall means, said nozzle means having an open outer end for discharging liquid from the container and a closed inner end for receiving fluid from said sleeve means.

12. A device according to claim 11, wherein said plunger means includes top plate means above and spaced apart from said closed inner end of said nozzle means for movement towards and away from said closed inner end to open and close said valve means.

13. A device according to claim 12, wherein said valve means includes a recess in said head means for receiving said plunger means.

14. A device according to claim 11, including cover means on said nozzle means slidable between a closed position in which the cover means prevents downward movement of said top plate means and an open position permitting such movement.

* * * * *